US008633880B2

(12) United States Patent
Kurihara

(10) Patent No.: US 8,633,880 B2
(45) Date of Patent: Jan. 21, 2014

(54) DISPLAY DEVICE WITH IMPROVED SMOOTH TONE DISPLAY UTILIZING DIFFERENT SETS OF TONE VOLTAGES CONVERTED FROM DISPLAY DATA BASED ON DIFFERENT CONVERSION CHARATERISTICS

(75) Inventor: Hiroshi Kurihara, Mobara (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 874 days.

(21) Appl. No.: 12/230,366

(22) Filed: Aug. 28, 2008

(65) Prior Publication Data

US 2009/0058890 A1 Mar. 5, 2009

(30) Foreign Application Priority Data

Aug. 31, 2007 (JP) ..... 2007-226307

(51) Int. Cl.
*G09G 3/36* (2006.01)

(52) U.S. Cl.
USPC ..... 345/89

(58) Field of Classification Search
USPC ..... 345/77, 87, 89, 690
See application file for complete search history.

(56) References Cited

U.S. PATENT DOCUMENTS

| | | | | |
|---|---|---|---|---|
| 2002/0033789 | A1* | 3/2002 | Miyata et al. | 345/89 |
| 2007/0013633 | A1* | 1/2007 | Kamada et al. | 345/98 |
| 2007/0171163 | A1* | 7/2007 | Miyata | 345/87 |

FOREIGN PATENT DOCUMENTS

| | | |
|---|---|---|
| JP | 2006-343706 | 12/2006 |
| WO | WO 2006/121188 A1 | 11/2006 |

* cited by examiner

*Primary Examiner* — Chanh Nguyen
*Assistant Examiner* — Ram Mistry
(74) *Attorney, Agent, or Firm* — Antonelli, Terry, Stout & Kraus, LLP.

(57) ABSTRACT

When one frame period of two consecutive frame periods is a frame A and a next frame period subsequent to the frame A is a frame B, a tone requested from an external system is displayed in each sub-pixel by displaying two tones during the two frame periods including the frame A and the frame B, display data of an image A displayed during a period of the frame A and display data of an image B displayed during a period of the frame B are display data generated based on the display data and a video line driving circuit supplies, as tone voltages corresponding to the display data, a first set of tone voltages to video lines during the period of the frame A and a second set of tone voltages to the video lines during the period of the frame B subsequent to the frame A.

8 Claims, 9 Drawing Sheets

FIG.5

| | | | | |
|---|---|---|---|---|
| INPUT DISPLAY DATA | Nth FRAME | | (N+1)th FRAME | |
| LIQUID CRYSTAL DRIVING DATA | (n-1)th FRAME (LIGHT) | (n-1)th FRAME (DARK) | nth FRAME (LIGHT) | nth FRAME (DARK) |
| TONE REFERENCE VOLTAGE TRANSFER | A | B | A | B |
| TONE VOLTAGE | VOLTAGE VALUE BASED ON B | VOLTAGE VALUE BASED ON A | VOLTAGE VALUE BASED ON B | VOLTAGE VALUE BASED ON A |
| TONE VOLTAGE FROM DRAIN DRIVER | DISPLAY DATA OF (n-2)th FRAME (DARK) HAVING VOLTAGE VALUE BASED ON B | DISPLAY DATA OF (n-1)th FRAME (LIGHT) HAVING VOLTAGE VALUE BASED ON A | DISPLAY DATA OF (n-1)th FRAME (DARK) HAVING VOLTAGE VALUE BASED ON A | DISPLAY DATA OF nth FRAME (LIGHT) HAVING VOLTAGE VALUE BASED ON A |

FIG.7

| | | | | |
|---|---|---|---|---|
| INPUT DISPLAY DATA | Nth FRAME | | (N+1)th FRAME | |
| LIQUID CRYSTAL DRIVING DATA | (n-1)th FRAME (LIGHT) | (n-1)th FRAME (DARK) | nth FRAME (LIGHT) | nth FRAME (DARK) |
| SWITCHING SIGNAL | | | | |
| TONE VOLTAGE | VOLTAGE VALUE BASED ON B | VOLTAGE VALUE BASED ON A | VOLTAGE VALUE BASED ON B | VOLTAGE VALUE BASED ON A |
| TONE VOLTAGE FROM DRAIN DRIVER | DISPLAY DATA OF (n-2)th FRAME (DARK) HAVING VOLTAGE VALUE BASED ON B | DISPLAY DATA OF (n-1)th FRAME (LIGHT) HAVING VOLTAGE VALUE BASED ON A | DISPLAY DATA OF (n-1)th FRAME (DARK) HAVING VOLTAGE VALUE BASED ON A | DISPLAY DATA OF nth FRAME (LIGHT) HAVING VOLTAGE VALUE BASED ON A |

FIG.8

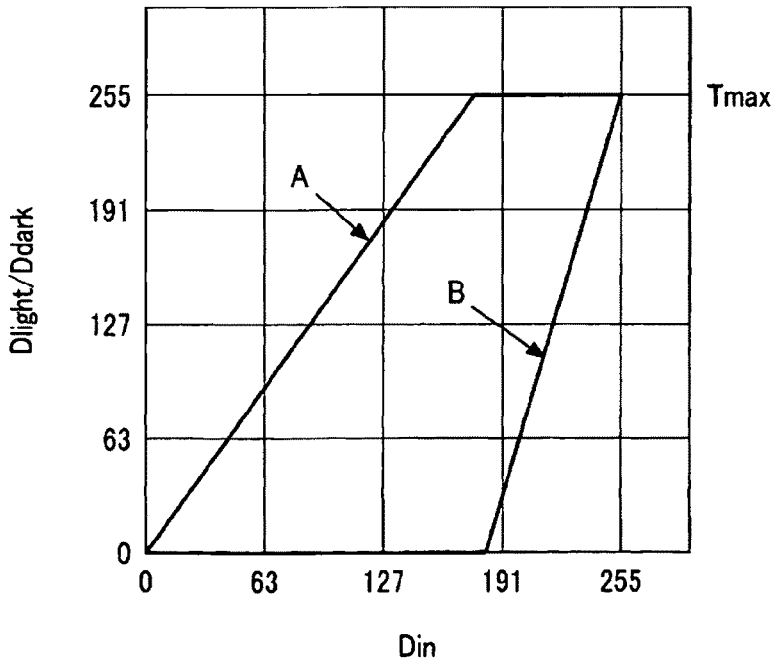

FIG.9

| Din | Dlight | Ddark |
|---|---|---|
| 0 | 0 | 0 |
| 15 | 21 | 0 |
| 31 | 42 | 0 |
| 47 | 64 | 0 |
| 63 | 86 | 0 |
| 79 | 108 | 0 |
| 95 | 130 | 0 |
| 111 | 152 | 0 |
| 127 | 174 | 0 |
| 143 | 196 | 0 |
| 159 | 218 | 0 |
| 175 | 240 | 0 |
| 191 | 255 | 70 |
| 207 | 255 | 139 |
| 223 | 255 | 184 |
| 239 | 255 | 222 |
| 255 | 255 | 255 |

DISPLAY DEVICE WITH IMPROVED SMOOTH TONE DISPLAY UTILIZING DIFFERENT SETS OF TONE VOLTAGES CONVERTED FROM DISPLAY DATA BASED ON DIFFERENT CONVERSION CHARATERISTICS

CROSS-REFERENCE TO RELATED APPLICATIONS

The present application claims priority from Japanese application JP 2007-226307 filed on Aug. 31, 2007, the content of which is hereby incorporated by reference into this application.

BACKGROUND OF THE INVENTION

1. Field of the Invention

The present invention relates to a hold-type display device such as a liquid crystal display device, an organic electroluminescence (hereinafter referred to as "EL") display, and an LCOS (Liquid Crystal On Silicon) display, and, in particular, to a display device suitable for display of an animated image.

2. Description of Related Art

When display devices are classified, in particular, from a viewpoint of the display of animated images, the display devices can be classified primarily into impulse-response display devices and hold-response display devices. Hold-response display devices are display devices of a type in which brightness which is based on display data is maintained until a next scanning, such as liquid crystal display devices.

A property of the hold-response display device is that a superior display quality without flicker can be obtained for a still image, but an animated-image blur occurs for the animated image in which the periphery of a moving object becomes blurry, and the display quality is significantly reduced.

Because a cause of this animated-image blur is a retina persistence in which the viewer interpolates display images before and after a movement with respect to the display image having the brightness held during the movement of the viewing line following the movement of the object, the animated-image blur cannot be completely resolved with improvement of the response speed of the display device.

In order to resolve this problem, effective methods include updating the display image with a shorter frequency or temporarily cancelling the retina persistence with insertion of a black screen of the like, to achieve a display similar to the impulse-response display devices.

As a method of approaching the impulse-response display devices, there is known a method in which a plurality of tones are displayed in two consecutive frame periods of a light frame and a dark frame so that a tone which is requested from an external system is virtually displayed (hereinafter referred to as "FBI driving method") (refer to the below-described Patent Document 1).

In the FBI driving method, when the tone requested from the external system is an intermediate low tone, at least one tone of the plurality of tones is set as a minimum tone (minimum brightness), and, when the tone requested from the external system is an intermediate high tone, at least one of the other tones among the plurality of the tones is set as the maximum tone (maximum brightness).

In other words, when the tone requested from the external system is on a side of the low tone, a predetermined tone is displayed during the light frame period and the minimum tone is displayed during the dark frame period in a switching manner, to virtually display the tone requested from the external system. On the other hand, when the tone requested from the external system is on the side of the high tone, the maximum tone is displayed during the light frame period and a predetermined tone is displayed during the dark frame period in a switching manner, to virtually display the tone requested from the external system.

As a related art reference related to the present invention, there exists the following reference.

[Patent Document 1] JP 2006-343706 A

SUMMARY OF THE INVENTION

In the above-described FBI driving method, input display data is converted to display data for light frame and display data for dark frame using a lookup table and a tone voltage is output from a drain driver based on the converted display data.

However, because the tone voltage generated by the drain driver is a common value for the light frame and the dark frame, there exists a point in which a change of a combined relative brightness in which the relative brightnesses of the light frame and the dark frame are combined is steep. Because of this, there may be cases in which a smooth tone display cannot be realized even when the voltage values of the driver corresponding to the tones are adjusted.

The present invention was conceived in view of the above-described disadvantages of the related art, and an object of the present invention is to provide a technique which allows realization of a smooth tone display in a display device which employs the FBI driving method.

The above-described and other objects and characteristics of the present inventions will become apparent by the following description and the attached drawings.

According to various aspects of the present invention, there are provided:

(1) a display device comprising a display panel having a plurality of sub-pixels and a plurality of video lines which input tone voltages to the sub-pixels, and a video line driving circuit which supplies, based on input display data, the tone voltage corresponding to the display data to each of the video lines, wherein, when one frame period of two consecutive frame periods is a frame A and a next frame period subsequent to the frame A is a frame B, the sub-pixel displays one tone requested from an external system by displaying two tones during the two frame periods including the frame A and the frame B, display data of an image A which is displayed during a period of the frame A and display data of an image B which is displayed during a period of the frame B are display data which are generated based on display data which is input from the external system, and the video line driving circuit supplies, as the tone voltage corresponding to the display data, a first set of tone voltages to the video lines during the period of the frame A and a second set of tone voltages to the video lines during the period of the frame B which is subsequent to the frame A;

(2) a display device according to (1), wherein, when the tone requested from the external system is included on a side of a low tone among intermediate tones between a maximum tone and a minimum tone, the tone during the period of the frame A changes corresponding to the tone requested from the external system and the tone during the period of the frame B is set to the minimum tone, and, when the tone requested from the external system is included on a side of a high tone among the intermediate tones, the tone during the period of the frame A is set to the maximum tone and the tone during the period of the frame B changes corresponding to the tone requested from the external system;

(3) a display device according to (2), wherein a boundary between the side of low tone and the side of high tone for the tone requested from the external system is a tone which is obtained by setting one of the two tones in the consecutive frame periods including the period of the frame A and the period of the frame B as the minimum tone and setting the other of the two tones as the maximum tone;

(4) a display device according to anyone of (1)-(3), further comprising a frame memory which stores the display data which is input from the external system, a first lookup table which converts display data which is input from the external system and which is stored in the frame memory into the display data of the image A, a second lookup table which converts the display data which is input from the external system and which is stored in the frame memory into the display data of the image B, and a selector which selects the display data of the image A which is converted by the first lookup table or the display data of the image B which is converted by the second lookup table, and which inputs the selected display data into the video line driving circuit;

(5) a display device according to anyone of (1)-(4), further comprising a tone reference voltage generating circuit which generates a plurality of tone reference voltages, wherein the video line driving circuit comprises a tone voltage generating circuit which generates a tone voltage based on a plurality of the tone reference voltages which are input from the tone reference voltage generating circuit, the tone reference voltage generating circuit generates a first set of the plurality of the tone reference voltages during the period of the frame A and generates a second set of the plurality of the tone reference voltages during the period of the frame B, and the tone voltage generating circuit generates the first set of the tone voltages based on the first set of the plurality of tone reference voltages which are input from the tone reference voltage generating circuit and generates the second set of the tone voltages based on the second set of the plurality of tone reference voltages which are input from the tone reference voltage generating circuit;

(6) a display device according to (5), further comprising a display controlling circuit, wherein the tone reference voltage generating circuit sets, based on tone reference voltage data from the display controlling circuit, voltages of the first set of the plurality of tone reference voltages which are generated during the period of the frame A and voltages for the second set of the plurality of tone reference voltages which are generated during the period of the frame B;

(7) a display device according to (5), wherein the tone reference voltage generating circuit comprises a first tone reference voltage generating circuit which generates the first set of the plurality of tone reference voltages, a second tone reference voltage generating circuit which generates the second set of the plurality of tone reference voltages, and a selector which selects one of outputs of the first tone reference voltage generating circuit and of the second tone reference voltage generating circuit, and the selector selects, during the period of the frame A, the first set of the plurality of tone reference voltages which are generated by the first tone reference voltage generating circuit and selects, during the period of the frame B, the second set of the plurality of tone reference voltages which are generated by the second tone reference voltage generating circuit;

(8) a display device according to (6) or (7), wherein absolute values of the second set of the plurality of tone reference voltages are larger than absolute values of the first set of the plurality of tone reference voltages at a same tone.

According to various aspects of the present invention, the following advantages can be obtained.

According to the present invention, a smooth tone display can be realized in a display device which employs the FBI driving method.

BRIEF DESCRIPTION OF THE DRAWINGS

FIG. 5 is a diagram for explaining an operation of a liquid crystal display module of a first preferred embodiment according to the present invention.

FIG. 7 is a diagram for explaining an operation of a liquid crystal display module of a second preferred embodiment according to the present invention.

FIG. 8 is a diagram which shows a conversion characteristic from input display data into display data for light frame and display data for dark frame in a liquid crystal display module of a preferred embodiment according to the present invention.

FIG. 9 is a diagram showing another example structure of a lookup table shown in FIG. 1.

DETAILED DESCRIPTION OF THE INVENTION

Figure 1:
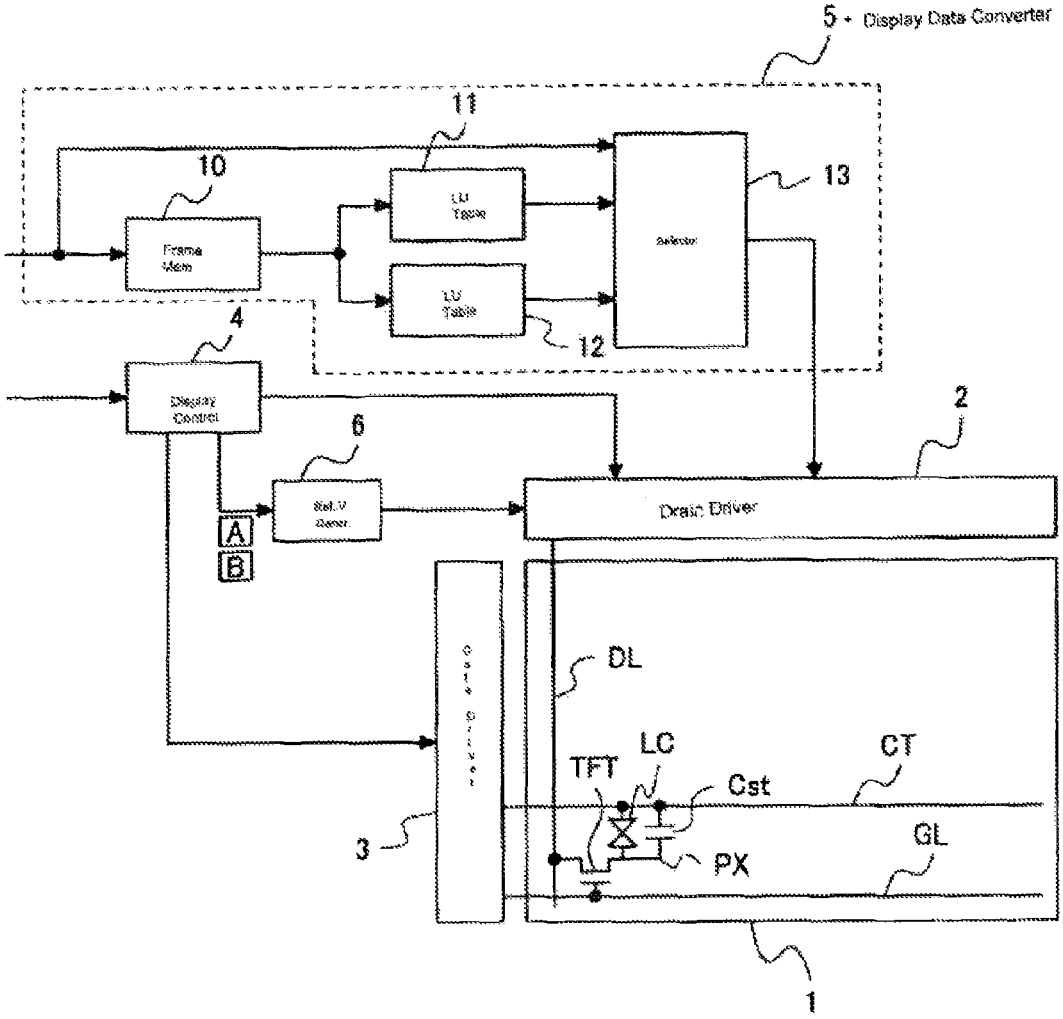
FIG. 1 is a block diagram schematically showing a structure of a liquid crystal display module of a first preferred embodiment according to the present invention.

Preferred embodiments of the present invention will now be described in detail with reference to the drawings.

In the description of the preferred embodiments, elements in the drawings having the same function are assigned the same reference numerals and will not be repeatedly described.

First Preferred Embodiment

FIG. 1 is a block diagram schematically showing a structure of a liquid crystal display module of a first preferred embodiment of the present invention.

A liquid crystal display module of the present embodiment comprises a liquid crystal display panel 1, a drain driver (a video line driving circuit of the present invention) 2, a gate driver 3, a display controlling circuit 4, a display data converting circuit 5, and a tone reference voltage generating circuit 6.

The drain driver 2 and the gate driver 3 are placed at a periphery of the liquid crystal display panel 1. The gate driver 3 comprises a plurality of gate driver ICs which are placed on one side of the liquid crystal display panel 1. The drain driver 2 comprises a plurality of drain driver ICs which are placed on another side of the liquid crystal display panel 1.

The display controlling circuit 4 drives the gate driver 3 and the drain driver 2 based on signals, which are input from an external system (such as, for example, a main body of TV or a main body of PC), including a vertical synchronization signal (Vsync) which defines one frame period (period in which one screen is displayed), a horizontal synchronization signal (Hsync) which defines one horizontal scan period (period in which one line is displayed), a display timing signal (DISP) which defines an effective period of the display data, and a reference clock signal (DCLK) which is synchronized with the display data.

In FIG. 1, DL represents a video line (which is also called a drain line or a source line), GL represents a scan line (which is also called a gate line), PX represents a pixel electrode of each color (red, green, and blue), CT represents an opposing electrode (which is also called a common electrode), LC represents a liquid crystal capacity which shows the liquid crystal layer in an equivalent form, and Cst represents a storage capacitor which is formed between the opposing electrode (CT) and the pixel electrode (PX).

In the liquid crystal display panel 1 of the present embodiment, a drain electrode of a thin film transistor (hereinafter referred to as "TFT") of each of the sub-pixels placed along the column direction is connected to the video line (DL) and the video line (DL) is connected to the drain driver 2 which supplies the video voltages corresponding to the display data to the sub-pixels placed along the column direction.

A gate electrode of the thin film transistor (TFT) in each of the sub-pixels placed along the row direction is connected to the scan line (GL), and the scan line (GL) is connected to the gate driver 3 which supplies a scan voltage (a positive or negative bias voltage) to the gate of the thin film transistor (TFT) for one horizontal scan period.

The gate driver 3 supplies a selection scan voltage to the scan line (GL) under the control of the display controlling circuit 4 and the drain driver 2 supplies the video voltage to the video line (DL) under the control of the display controlling circuit 4.

When an image is displayed on the liquid crystal display panel 1, the gate driver 3 selects the scan lines (GL) sequentially from the top to the bottom (or bottom to top). During a period when a certain scan line (GL) is selected, the drain driver 2 supplies a video voltage corresponding to the display data to the video line (DL) and applies the video voltage to the pixel electrode (PX).

The voltage supplied to the video line (DL) is applied to the pixel electrode (PX) through the thin film transistor (TFT), and ultimately, charges are charged in the storage capacitor (Cst) and the liquid crystal capacity (LC) and an image is displayed by controlling the liquid crystal molecules.

The liquid crystal display panel 1 is constructed by overlapping, with a predetermined gap therebetween, a first substrate (which is also called a TFT substrate or an active matrix substrate) over which the pixel electrode (PX), the thin film transistor (TFT), the video line (DL), and the scan line (GL) are provided and a second substrate (which is also called an opposing substrate) over which a color filter or the like is formed, adhering the substrates with a sealing member provided in a frame shape near a periphery of the substrates, filling and sealing liquid crystal inside the sealing member between the substrate through a liquid crystal filling entrance provided at a portion of the sealing member, and adhering a polarizer plate external to the substrates.

The opposing electrode (CT) is provided on the side of the second substrate in the liquid crystal display panel of a TN-type or a VA-type. In the IPS-type liquid crystal display device, the opposing electrode (CT) is provided on the side of the first substrate.

Because the present invention is not related to the internal structure of the liquid crystal panel, the internal structure of the liquid crystal panel will not be described in detail. The present invention can be applied to a liquid crystal panel of any structure.

In addition, although in an actual product, a backlight is placed behind the liquid crystal display panel 1, because the present invention is not related to the structure of the backlight, the backlight will not be described in detail.

Figure 2:
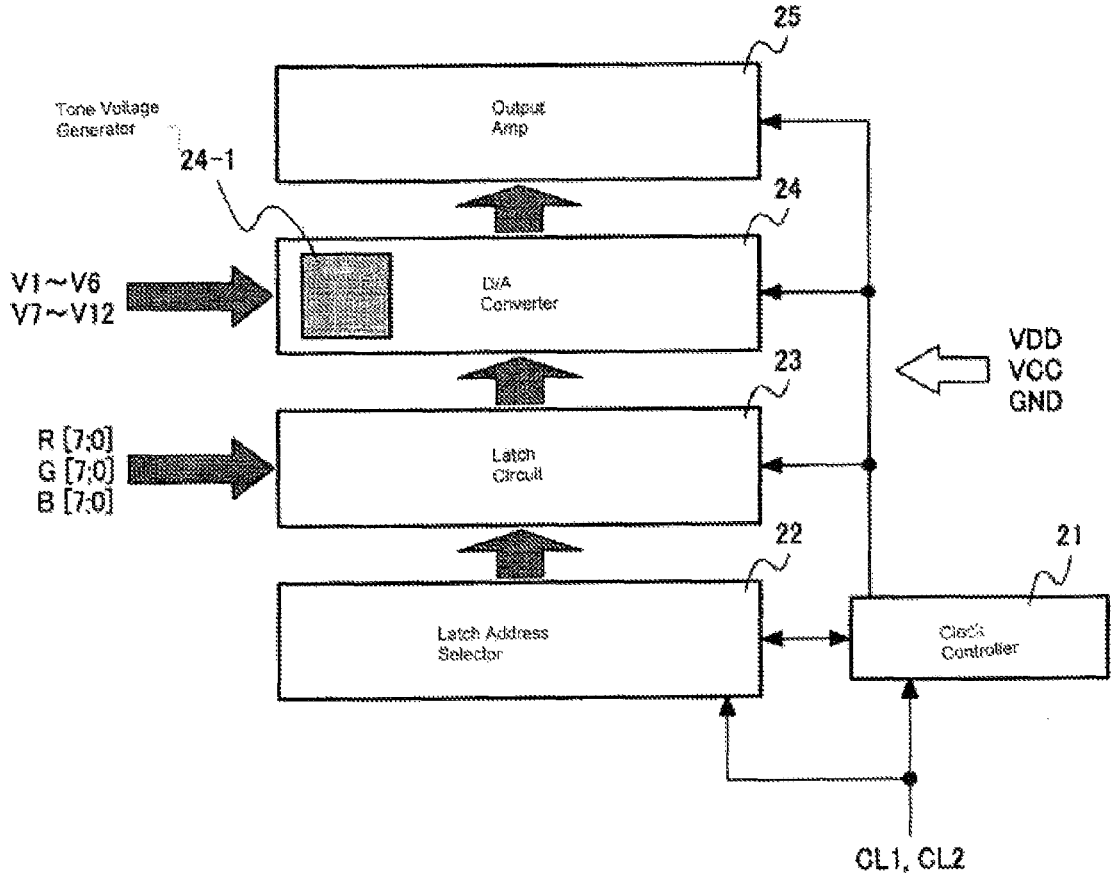
FIG. 2 is a block diagram schematically showing an example structure of a drain driver shown in FIG. 1.

FIG. 2 is a block diagram schematically showing an example structure of a drain driver 2 shown in FIG. 1.

In FIG. 2, reference numeral 21 represents a clock controller, reference numeral 22 represents a latch address selector, reference numeral 23 represents a latch circuit, reference numeral 24 represents a D/A converter circuit, and reference numeral 25 represents an output amplifier circuit.

The latch circuit 23 sequentially latches display data which is input from the outside (here, display data of 8 bits of R[7:0], G[7:0], B[7:0]) in synchronization with a display data latching clock (CL2) which is output from the display controlling circuit 4, under the control of the latch address selector 22.

The display data which is latched in the latch circuit 23 is output to the D/A converter circuit 24 based on an output timing controlling clock signal (CL1) which is output from the display controlling circuit 4.

The D/A converter circuit 24 comprises a tone voltage generating circuit (24-1) which generates tone voltages of tones of 0-255 and having positive and negative polarities based on tone reference voltages of V1-V6 having a positive polarity and tone reference voltages V7-V12 having negative polarities, which are input from the tone reference voltage generating circuit 6.

The D/A converter circuit 24 selects a tone voltage corresponding to the display data which is input from the latch circuit 23 from among tone voltages of tones of 0-255 and having a positive and negative polarities, which are generated by the tone voltage generating circuit (24-1), and inputs the selected tone voltage into the output amplifier circuit 25.

The output amplifier circuit 25 amplifies, with an amplifier circuit, the current of the tone voltage which is input from the D/A converter circuit 24 and outputs the amplified voltage to the corresponding video line (DL).

Figure 3A:
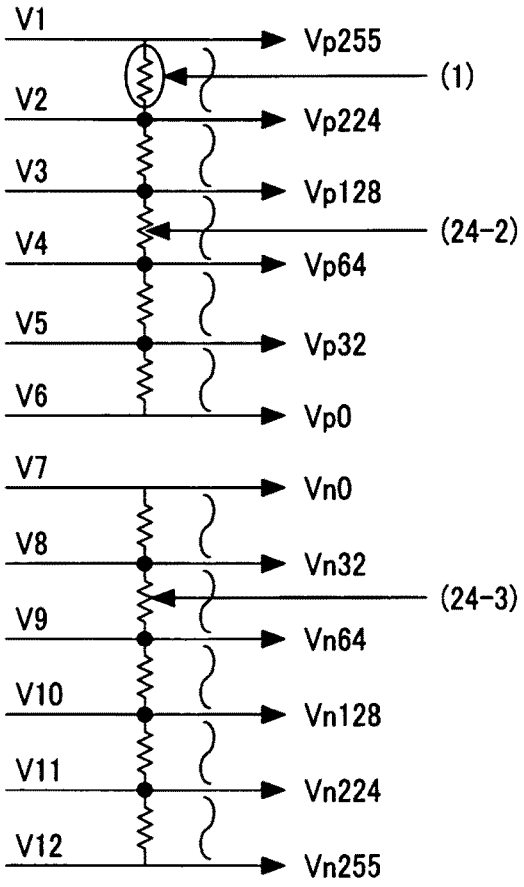
FIG. 3A is a diagram showing a circuit structure of a tone voltage generating circuit shown in FIG. 2.
Figure 3B:
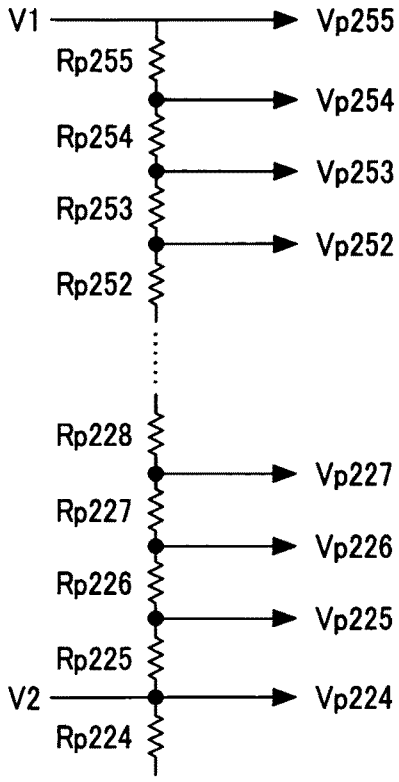
FIG. 3B is a diagram showing a circuit structure of a tone voltage generating circuit shown in FIG. 2.

FIGS. 3A and 3B are diagrams showing a circuit structure of the tone voltage generating circuit (24-1) shown in FIG. 2. FIG. 3A shows an overall circuit structure and FIG. 3B is a diagram enlarging a portion shown in FIG. 3A with (1).

As shown in FIG. 3A, the tone voltage generating circuit (24-1) shown in FIG. 2 comprises a portion which divides, with a series resistor voltage divider circuit (24-2), the tone reference voltages among the tone voltages (V1-V6) of six values which are input from the tone reference voltage generating circuit 6 and generates tone voltages (Vp0-Vp255) of tones of 0-255 of the positive polarity and a portion which divides, with a series resistor voltage dividing circuit (24-3), the tone reference voltages among tone reference voltages (V7-V12) of six values which are input from the tone reference voltage generating circuit 6 and generates tone voltages (Vn0-Vn255) of tones of 0-255 of the negative polarity.

In the liquid crystal display module of the present embodiment, in order to improve the animated image characteristics, a double-speed driving is employed having a frame period of (1/120) seconds. For this purpose, a display data converting circuit 5 is provided.

The display data converting circuit 5 comprises a frame memory 10, a lookup table 11 which stores an FBI setting value for light frame, a lookup table 12 which stores an FBI setting value for dark frame, and a selector 13.

Display data is input from the outside every (1/60) seconds and the display data is stored in the frame memory 10.

The display data for display which is stored in the frame memory 10 is read every (1/120) seconds and is converted into the display data for light frame with the lookup table 11 or to display data for dark frame with the lookup table 12, and one of the display data is input to the drain driver 2 by the selector 13.

The FBI process of the related art will now be briefly described.

FIG. 8 is a diagram showing conversion characteristics from the input display data to the display data for light frame and from the input display data to the display data for dark frame, with the horizontal axis representing the input display data and the vertical axis representing the display data for light frame and the display data for dark frame. In FIG. 8, A represents the conversion characteristic to the display data for light frame and "B" represents the conversion characteristic to the display data for dark frame. In general, in the liquid crystal display panel, a static brightness T changes according to an applied voltage V to the liquid crystal, with Tmin being the minimum brightness and Tmax being the maximum brightness.

The conversion algorithm of the FBI process of the related art realizes a viewing brightness corresponding to the input display data by combining the light frame and the dark frame, with conditions that a dynamic brightness which is as close to Tmin of the liquid crystal display panel is obtained during the dark frame and the static brightness of the tone of 256 which achieves the brightest brightness for the input display data is equivalent to Tmax.

The animated-image blur can be reduced as the dynamic brightness during the dark frame is reduced and as a range in which the dynamic brightness during the dark frame is small is enlarged. Therefore, it is preferable that the dynamic brightness is at Tmin during the dark frame, but may be a brightness which is slightly higher than Tmin. The range where the dynamic brightness during the dark frame is Tmin is a range from a tone of 0 to a tone of input display data corresponding to the viewing brightness obtained by setting the dynamic brightness during the light frame to Tmax and the dynamic brightness during the dark frame to Tmin. Alternatively, the range may be a range up to a tone which is slightly less than the tone of the input display data corresponding to a viewing brightness obtained by setting the dynamic brightness during the light frame to Tmax and the dynamic brightness during the dark frame to Tmin.

The range in which the dynamic brightness during the light frame is Tmax is a range from a tone of the input display data corresponding to the viewing brightness obtained by setting the dynamic brightness during the light frame to Tmax and the dynamic brightness during the dark frame as Tmin to the tone of 256. Alternatively, the range may be from a tone which is slightly less than the tone of the input display data corresponding to the viewing brightness obtained by setting the dynamic brightness during the light frame as Tmax and the dynamic brightness during the dark frame as Tmin.

In a display, it is preferable that the brightness differences between the tones are close to equal distances when viewed by human eyes. In general, with 256 tones, a relationship between display data D for liquid crystal driving and static brightness T is designed to satisfy the following Equation (1), which is often referred to as a γ curve.

$$(\text{Static Brightness } T) = (\text{Liquid Crystal Driving Data } D/255)^{\wedge}\gamma \qquad \text{[Equation 1]}$$

Because γ=2.2 is generally used, the embodiment will be described with γ=2.2.

When a rise time Tr and fall time Tf of the liquid crystal display panel 1 are both 0, the display brightness can be approximated with the following Equation (2).

$$\text{Display Brightness} = (\text{Static Brightness of Light Frame } T/2) + (\text{Static Brightness } T \text{ of Dark Frame } T)/2 \qquad \text{[Equation 2]}$$

When the input display data is Din, the display data for light frame is Dlight, and the display data for dark frame is Ddark, the following Equation (3) is obtained for γ=2.2 based on Equations (1) and (2).

$$Dlight = \begin{cases} 2^{\wedge}(1/2.2) * Din & \text{WHEN } 2^{\wedge}(1/2.2) * Din < 255 \\ 255 & \text{WHEN } 2^{\wedge}(1/2.2) * Din \geqq 255 \end{cases}$$

$$Ddark = \begin{cases} 0 & \text{WHEN } 2^{\wedge}(1/2.2) * Din < 255 \\ 255 * \{2 * (Din/255)^{\wedge}2.2 - 1\}^{\wedge}(1/2.2) & \text{WHEN } 2^{\wedge}(1/2.2) * Din \geqq 255 \end{cases}$$

The lookup tables of 216 and 217 do not need to have table values for all input display data (Din), and if the linearity between tones can be sufficiently satisfied, for example, as shown in FIG. 9, a table for every 16 tones can be prepared and conversion display data can be generated through interpolation such as linear interpolation for intermediate tones. With such a configuration, the size of the conversion table can be reduced.

A problem in the FBI driving method of the related art will now be described.

Figure 10:
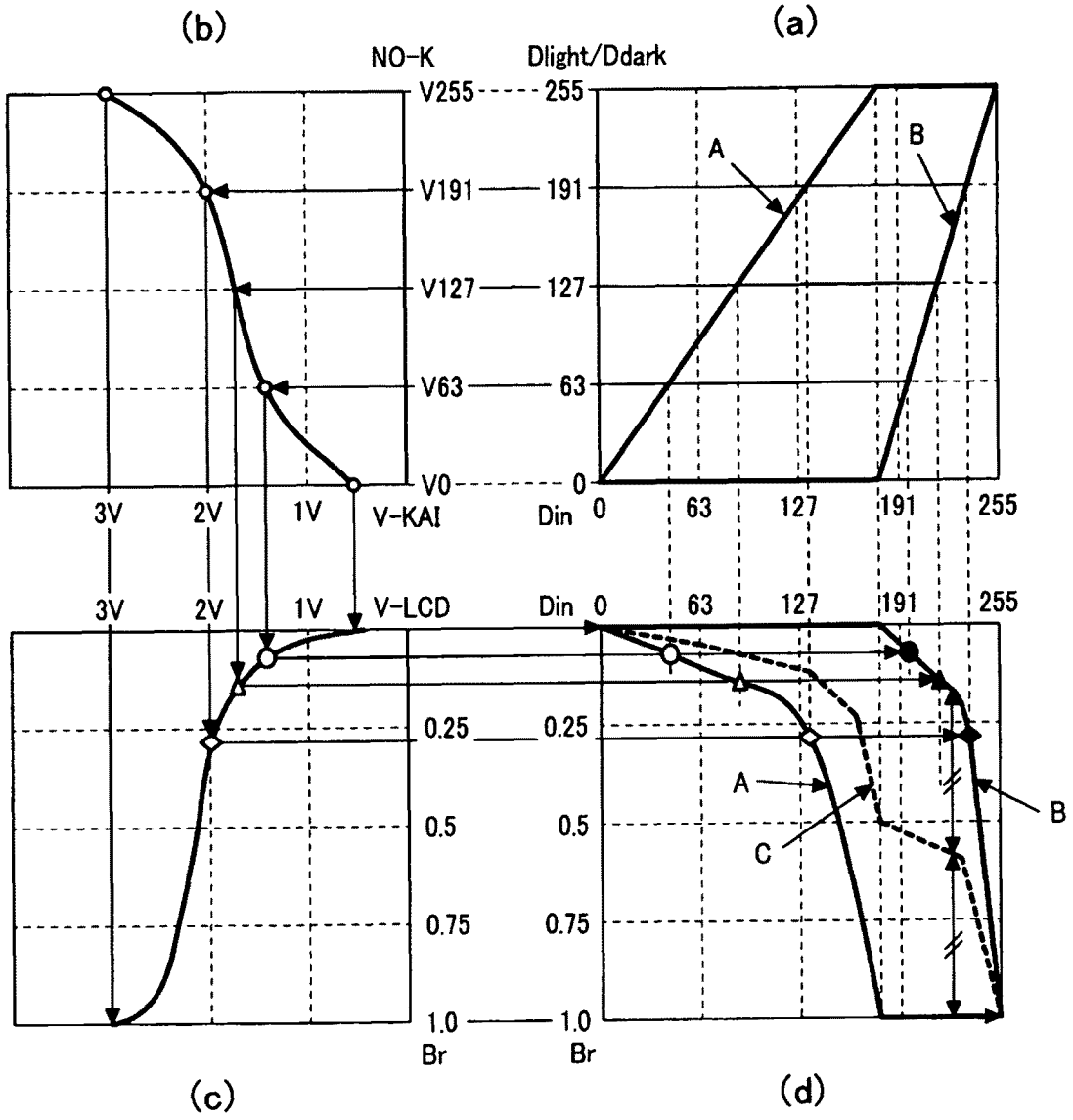
FIG. 10 is a diagram for explaining a problem of the FBI driving method of related art.

FIG. 10 is a diagram for explaining a problem in the FBI driving method of the related art. FIG. 10 is a diagram of a structure having 5 inputs for the tone reference voltages to be input to the drain driver 2, including tones of 0, 63, 127, 191, and 255. In reality, tone reference voltages corresponding to the positive polarity and to the negative polarity are input, but these are not shown in order to simplify the description. In addition, the structure operates in a normally black-displaying mode in which a higher tone voltage supplied to each sub-pixel results in a higher brightness.

FIG. 10-(*a*) shows a relationship among the input display data (Din), the display data for light frame (Dlight), and the display data for dark frame (Ddark), and is a diagram similar to FIG. 8. In FIG. 10-(*a*), "A" represents a conversion characteristic to the display data for light frame and "B" represents the conversion characteristic to the display data for dark frame.

FIG. 10-(*b*) shows a relationship between a tone reference voltage (NO-K) and a tone voltage of each tone (V-KAI).

FIG. 10-(*c*) shows a relationship between an applied voltage to the liquid crystal (V-LCD) and a relative brightness (Br). FIGS. 10-(*b*) and 10-(*c*) show voltages in a case where the voltage (Vcom) which is input to the opposing electrode (CT) is 0V, in order to simplify the description.

FIG. 10-(*d*) shows a relationship between the input display data (Din) and the relative brightness (Br). In FIG. 10-(*d*), "A" represents a relative brightness in the light frame, "B" represents relative brightness in the dark frame, and C represents a combined relative brightness when "A" and "B" are combined.

Here, in reality, because the response time from the light frame to the dark frame does not match the response time from the dark frame to the light frame, the combined brightness is not an average value of the brightnesses of the dark frame and the light frame. However, in order to simplify the description, the combined brightness is shown as a simple average of the light frame and the dark frame.

As is clear from the combined relative brightness shown by C of FIG. 10-(*d*), a change of the combined relative brightness is steep around the tone reference voltage of V127, and a smooth tone display cannot be obtained.

In the FBI driving method of the related art, because a common tone reference voltage is input for both of the dark frame and the light frame, although the voltages of ○ and ● (that is, the tone reference voltage of V63) shown in FIG. 10-(*d*) can be adjusted, the voltages cannot be independently adjusted. This applies similarly for other tones.

As described, in the FBI driving method of the related art, because the tone reference voltages are identical in the dark frame and the light frame, the tone voltage is linked between the dark frame and the light frame, fine adjustment is difficult, and, as a result, adjustment for smooth brightness display when a tone pattern or the like is displayed is difficult.

Figure 4:
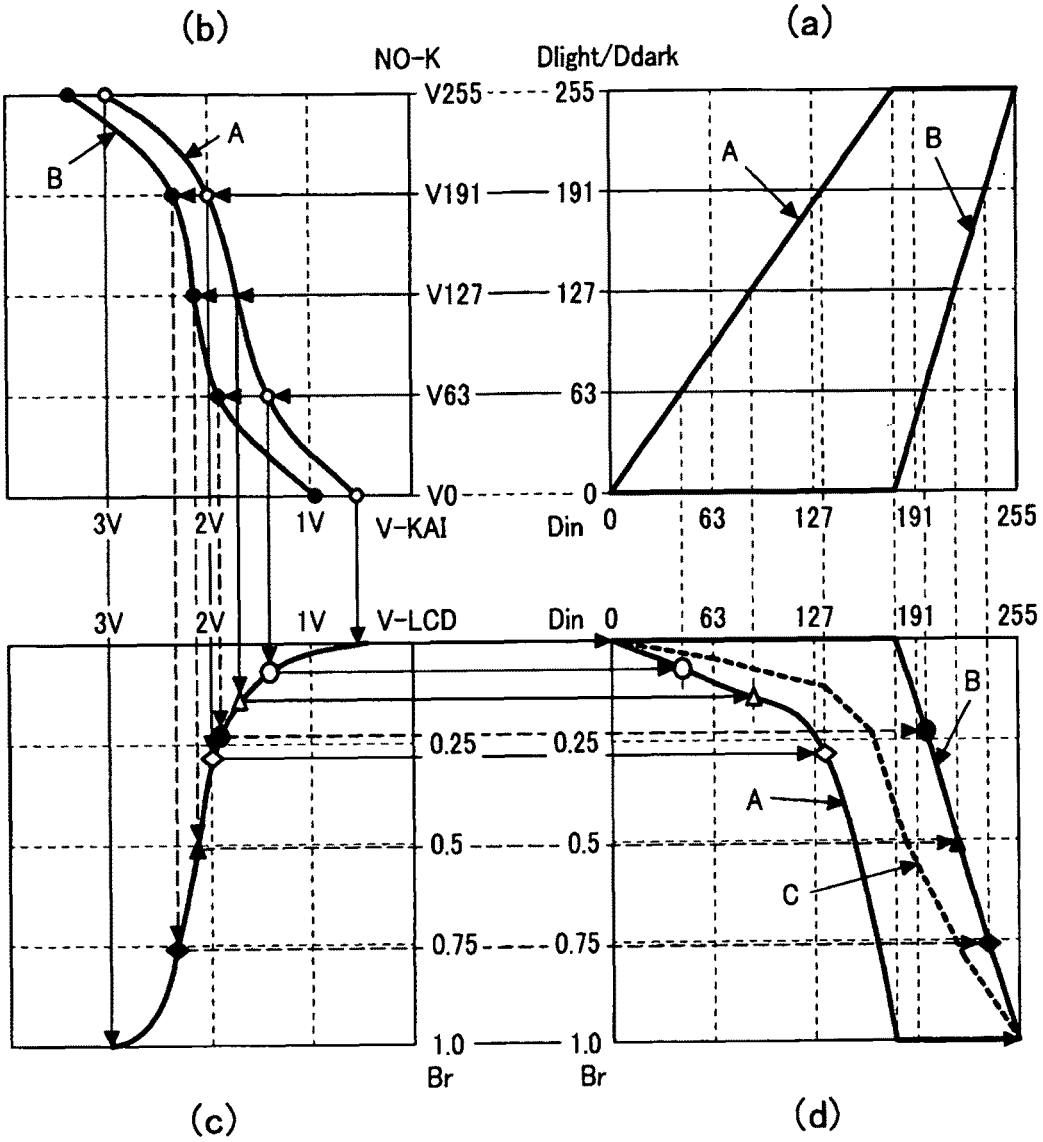
FIG. 4 is a diagram showing a relationship between a setting voltage and a relative brightness characteristic in the FBI driving method in a first preferred embodiment according to the present invention.

FIG. 4 is a diagram showing a relationship between a setting voltage and a relative brightness characteristic in an FBI driving method in the present embodiment.

FIG. 4 is a diagram for a structure having 5 inputs of the tone reference voltages to be input to the drain driver 2, including tones of 0, 63, 127, 191, and 255. In reality, tone reference voltages corresponding to the positive polarity and the negative polarity are also input, but these tone reference voltages are not shown in order to simplify the description. Here also, the structure operates in the normally black-displaying mode in which a higher tone voltage supplied to each sub-pixel results in higher brightness.

FIG. 4-(*a*) shows a relationship among the input display data (Din), the display data for light frame (Dlight), and the display data for dark frame (Ddark), and is similar to FIG. 8. In FIG. 4-(*a*), "A" represents a conversion characteristic to the display data for light frame and "B" represents a conversion characteristic to the display data for dark frame.

FIG. 4-(*b*) shows a relationship between a tone reference voltage (NO-K) and the tone voltage at each tone (V-KAI).

In the present embodiment, the tone reference voltage (NO-K) is set to different voltages between the light frame and the dark frame so that the tone voltage during the light frame and the tone voltage during the dark frame are changed. In FIG. 4-(*b*), "A" represents the tone voltage during the light frame and "B" represents the tone voltage during the dark frame. As is clear from FIG. 4-(*b*), "B" and "A" are in a relationship that the range of the tone voltage (V-KAI) is shifted to a side of a voltage having a larger absolute value for "B".

FIG. 4-(*c*) shows a relationship between the applied voltage to the liquid crystal (V-LCD) and the relative brightness (Br). In FIGS. 4-(*b*) and 4-(*c*), in order to simplify the description, a voltage is shown with the voltage (Vcom) which is input to the opposing electrode (CT) being set to 0V.

FIG. 4-(*d*) shows a relationship between the input display data (Din) and the relative brightness (Br). In FIG. 4-(*d*), "A" represents the relative brightness during the light frame, "B" represents the relative brightness during the dark frame, and C represents a combined relative brightness in which "A" and "B" are combined.

Here, because the response time from the light frame to the dark frame and the response time from the dark frame to the light frame do not match each other in reality, the combined brightness is not an average value of the brightnesses of the dark frame and the light frame. However, in order to simplify the description, the combined brightness is set as a simple average of the light frame and the dark frame.

In the present embodiment, because the tone reference voltage for the dark frame and the tone reference voltage for the light frame are set to differ from each other so that the tone voltage for the dark frame and the tone voltage for the light frame differ from each other, the combined relative brightness can be smoothly changed, as shown by C in FIG. 4-(*d*).

For this purpose, in the present embodiment, as shown in FIG. 1, the tone reference voltage generating circuit 6 generates a tone reference voltage for light frame and a tone reference voltage for dark frame, the tone reference voltages are input to the drain driver 2, and the tone voltage generating circuit (24-1) generates the tone voltage for light frame and the tone voltage for dark frame. As shown in FIG. 4-(*b*), in the present embodiment, at a same tone, the absolute value of the tone reference voltage for dark frame is larger than the absolute value of the tone reference voltage for light frame.

FIG. 5 is a diagram for explaining an operation of the present embodiment.

As shown in FIG. 5, the input display data (Din) is input every (1/60) seconds and the input display data is converted to the display data for light frame of (1/120) seconds and the display data for dark frame of (1/120) seconds.

In the present embodiment, the display controlling circuit holds tone reference voltage data "A" for light frame and tone reference voltage data "B" for dark frame, and the respective data is output to the tone reference voltage generating circuit 6 during a vertical return period.

The tone reference voltage generating circuit 6 generates the tone reference voltage for light frame (NO-k) and the tone reference voltage for dark frame (NO-K) based on the tone reference voltage data "A" for light frame and the tone reference voltage data "B" for dark frame, and the tone reference voltages are input to the drain driver 2.

The tone voltage generating circuit (24-1) of the drain driver 2 generates a tone voltage for light frame (V-KAI) and a tone voltage for dark frame (V-KAI).

As a result, the tone voltage for light frame as shown by "A" in FIG. 4-(*b*) and the tone voltage for dark frame as shown by "B" in FIG. 4-(*b*) can be generated.

Second Preferred Embodiment

Figure 6:
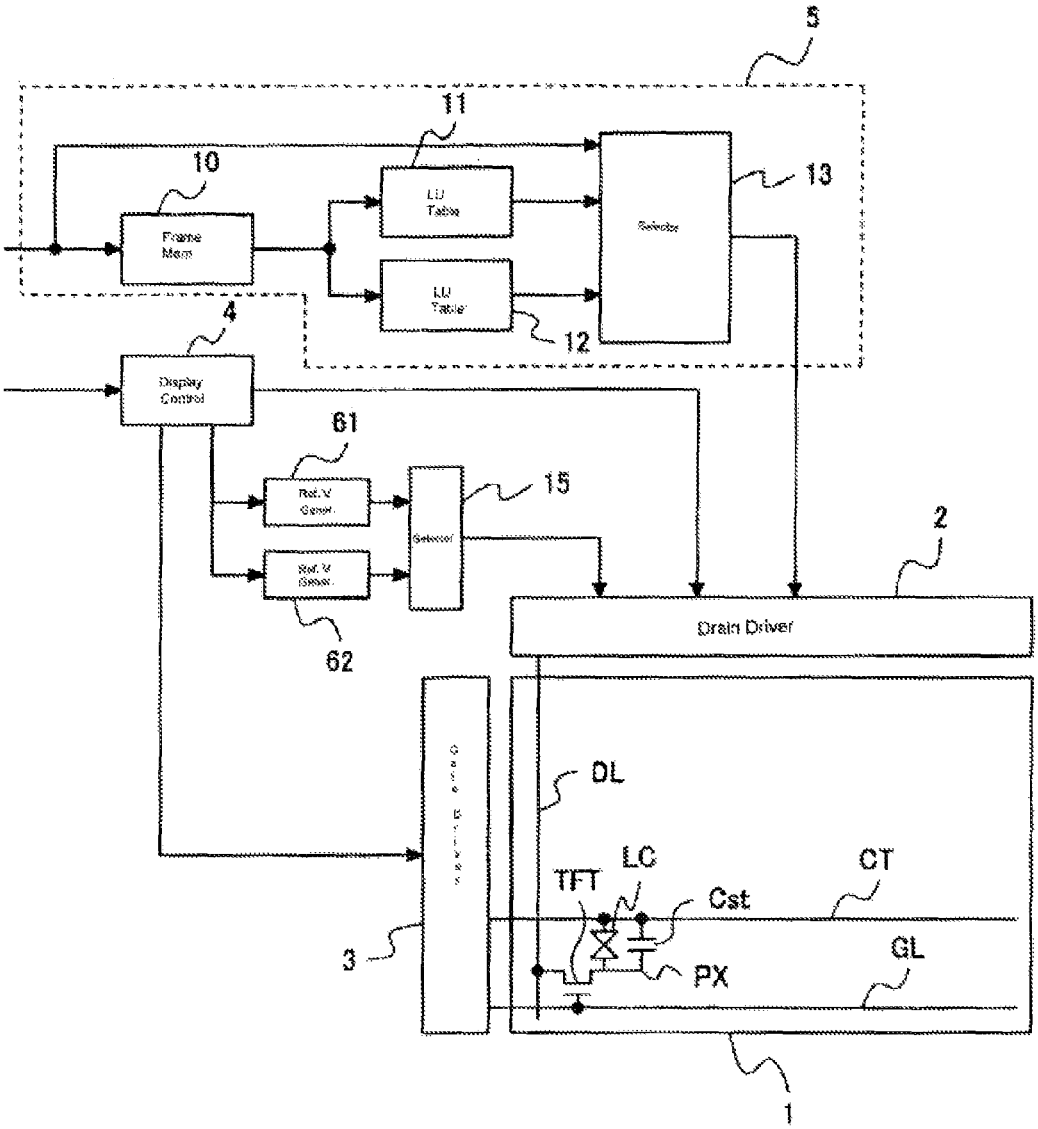
FIG. 6 is a block diagram schematically showing a structure of a liquid crystal display module of a second preferred embodiment according to the present invention.

FIG. 6 is a block diagram schematically showing a structure of a liquid crystal display module in a second preferred embodiment according to the present invention.

The liquid crystal display module of the present embodiment will now be described, the description being centered primarily on a difference from the liquid crystal display module of the first preferred embodiment.

The liquid crystal display module of the present embodiment differs from the liquid crystal display module of the first preferred embodiment in that the tone reference voltage generating circuit comprises a tone reference voltage generating circuit 61 for light frame, a tone reference voltage generating circuit 62 for dark frame, and a selector 15.

FIG. 7 is a diagram for explaining an operation of the present embodiment.

In the present embodiment, the tone reference voltage generating circuit 61 for light frame generates the tone reference voltage for light frame and the tone reference voltage generating circuit 62 for dark frame generates the tone reference voltage for dark frame. During the vertical return period, the tone reference voltage for light frame or tone reference voltage for dark frame is selected by the selector 15 and is input to the drain driver 2. The tone voltage generating circuit (24-1) of the drain driver 2 generates the tone voltage for light frame and the tone voltage for dark frame.

As described, according to the present embodiment, because the tone reference voltages differ between the light frame and the dark frame and the tone voltage can be independently set for light frame and dark frame, it is possible to easily set the lookup table and to easily adjust the tone voltage for achieving a smooth tone display for each frame.

With this structure, it is possible to realize a liquid crystal display module having a smooth tone display and having a superior animated image performance.

Although embodiments in which the present invention is applied to a liquid crystal display module have been described, the present invention can be applied to other hold-type display devices such as the organic EL (electroluminescence) displays and the LCOS (Liquid Crystal On Silicon) displays.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising:

a display panel having a plurality of sub-pixels and a plurality of video lines which input tone voltages to the sub-pixels, a video line driving circuit which supplies, based on input display data, the tone voltage corresponding to the display data to each of the video lines, and a tone voltage generating circuit which generates the tone voltages, wherein:

each frame period comprises a light frame period for a light frame and a dark frame period for a dark frame, subsequent to the light frame period, wherein, during the dark frame, a tone is displayed to reduce effects of animated-image blur on the display panel, and the sub-pixel displays one tone requested from an external system by displaying two tones during each frame period including the light frame and the dark frame period, display data of an image A which is displayed during a period of the light frame and display data of an image B which is displayed during a period of the dark frame are display data which are generated based on display data which is input from the external system, the video line driving circuit supplies, as the tone voltage corresponding to the display data, a first set of tone voltages to the video lines during the period of the light frame and a second set of tone voltages to the video lines during the period of the dark frame which is subsequent to the light frame, the first set of tone voltages are converted from the display data of the image A displayed during the light frame based on a second conversion characteristic by the tone voltage generating circuit, the second set of tone voltages are converted from the display data of the image B displayed during the dark frame based on a first conversion characteristic by the tone voltage generating circuit, a tone reference voltage for the light frame is set to be different from a tone reference voltage for the dark frame so that the tone voltage during the light frame and the tone voltage during the dark frame are changed such that, at a same tone, an absolute value of the tone voltage of the second set of tone voltages is larger than an absolute value of the tone voltage of the first set of tone voltages, and a viewing brightness is generated by combining the first set of tone voltages and the second set of tone voltages.

2. The display device according to claim 1, wherein when the tone requested from the external system is included on a side of a low tone among intermediate tones between a maximum tone and a minimum tone, the tone during the period of the light frame changes corresponding to the tone requested from the external system and the tone during the period of the dark frame is set to the minimum tone, and when the tone requested from the external system is included on a side of a high tone among the intermediate tones, the tone during the period of the light frame is set to the maximum tone and the tone during the period of the dark frame changes corresponding to the tone requested from the external system.

3. The display device according to claim 2, wherein a boundary between the side of low tone and the side of high tone for the tone requested from the external system is a tone which is obtained by setting one of the two tones in the consecutive frame periods including the period of the light frame and the period of the dark frame as the minimum tone and setting the other of the two tones as the maximum tone.

4. The display device according to claim 1, further comprising:

a frame memory which stores the display data which is input from the external system;

a first lookup table which converts display data which is input from the external system and which is stored in the frame memory into the display data of the image A;

a second lookup table which converts the display data which is input from the external system and which is stored in the frame memory into the display data of the image B; and a selector which selects the display data of the image A which is converted by the first lookup table or the display data of the image B which is converted by the second lookup table, and which inputs the selected display data into the video line driving circuit.

5. The display device according to claim 1, further comprising a tone reference voltage generating circuit which generates a plurality of tone reference voltages, wherein the video line driving circuit comprises a tone voltage generating circuit which generates a tone voltage based on a plurality of the tone reference voltages which are input from the tone reference voltage generating circuit, the tone reference voltage generating circuit generates a first set of the plurality of the tone reference voltages during the period of the light frame and generates a second set of the plurality of the tone reference voltages during the period of the dark frame, and the tone voltage generating circuit generates the first set of the tone voltages based on the first set of the plurality of tone reference voltages which are input from the tone reference voltage generating circuit and generates the second set of the tone voltages based on the second set of the plurality of tone reference voltages which are input from the tone reference voltage generating circuit.

6. The display device according to claim 5, further comprising a display controlling circuit, wherein the tone reference voltage generating circuit sets, based on tone reference voltage data from the display controlling circuit, voltages for the first set of the plurality of tone reference voltages which are generated during the period of the light frame and voltages for the second set of the plurality of tone reference voltages which are generated during the period of the dark frame.

7. The display device according to claim 5, wherein the tone reference voltage generating circuit comprises a first tone reference voltage generating circuit which generates the first set of the plurality of tone reference voltages, a second tone reference voltage generating circuit which generates the second set of the plurality of tone reference voltages, and a selector which selects one of outputs of the first tone reference voltage generating circuit and of the second tone reference voltage generating circuit, and the selector selects, during the period of the light frame, the first set of the plurality of tone reference voltages which are generated by the first tone reference voltage generating circuit and selects, during the period of the dark frame, the second set of the plurality of tone reference voltages which are generated by the second tone reference voltage generating circuit.

8. The display device according to claim 6 or 7, wherein absolute values of the second set of the plurality of tone reference voltages are larger than absolute values of the first set of the plurality of tone reference voltages at a same tone.

* * * * *